US010823503B2

(12) United States Patent
Phillips

(10) Patent No.: US 10,823,503 B2
(45) Date of Patent: Nov. 3, 2020

(54) SYSTEM AND METHOD FOR PASSIVELY DRYING ELECTRONIC DEVICES

(71) Applicant: Andrew F. Phillips, La Canada, CA (US)

(72) Inventor: Andrew F. Phillips, La Canada, CA (US)

( * ) Notice: Subject to any disclaimer, the term of this patent is extended or adjusted under 35 U.S.C. 154(b) by 177 days.

(21) Appl. No.: 16/118,057

(22) Filed: Aug. 30, 2018

(65) Prior Publication Data

US 2020/0072548 A1 Mar. 5, 2020

(51) Int. Cl.
*F26B 5/04* (2006.01)
*F26B 21/08* (2006.01)

(52) U.S. Cl.
CPC ..... *F26B 5/04* (2013.01); *F26B 21/083* (2013.01)

(58) Field of Classification Search
CPC ..... F26B 5/04; F26B 5/12; F26B 5/14; F26B 21/083; B61D 27/0009
USPC ..... 34/409, 404, 403, 402, 406
See application file for complete search history.

(56) References Cited

U.S. PATENT DOCUMENTS 5,671,546 A 9/1997 Haala
6,226,890 B1 * 5/2001 Boroson ..... F26B 21/083 252/194
8,689,461 B1 4/2014 Cookson et al.
9,709,327 B2 * 7/2017 Marchiori ..... F26B 5/12
9,816,757 B1 * 11/2017 Zielinski ..... F26B 5/04
2009/0145783 A1 * 6/2009 Forker ..... B65D 81/268 206/204
2010/0122470 A1 * 5/2010 Davis ..... F26B 21/083 34/472
2017/0232978 A1 * 8/2017 Zheng ..... B66B 1/28 454/70
2018/0141736 A1 * 5/2018 Bazbaz ..... B65D 75/5844
2019/0031423 A1 * 1/2019 De La Torre Barreiro ..... B65D 81/268

FOREIGN PATENT DOCUMENTS

WO WO2015/171967 A1 11/2015

* cited by examiner

*Primary Examiner* — John P McCormack
(74) *Attorney, Agent, or Firm* — Gordon & Jacobson, P.C.

(57) ABSTRACT

A kit for drying an electronic device includes a sealed storage container having a vacuum chamber that has been depressurized to a partial vacuum, and a drying container operably coupled to the storage container. The drying container includes a desiccant chamber containing a desiccant and a main chamber in fluid communication with the desiccant chamber. The main chamber is configured for housing an electronic device. According to one method, the drying container is loaded with an electronic device inside the main chamber and the container is sealed. Then, the storage container is fluidly coupled to the drying container. The fluid coupling between the storage container and the drying container causes the pressure in the main chamber to be at a partial vacuum, which promotes water removal from the electronic device and transfer of removed water into the desiccant.

15 Claims, 6 Drawing Sheets

SYSTEM AND METHOD FOR PASSIVELY DRYING ELECTRONIC DEVICES

BACKGROUND

1. Field

The present description relates to drying of electronic devices, and, more specifically, to a passive drying apparatus, system, and method, which can be used to remove water from wet electronic devices, such as cellular telephones.

2. State of the Art

Electronic devices, unless they are waterproof, often will not work after they get wet. For example, a common cause of damage to cellular telephones is water that has entered into the phone, such as from falling into a bathtub or swimming pool. Some electronic devices can be restored to working condition by removing the water that has entered into the devices.

There are passive and active methods of drying wet electronic devices, such as cell phones. As used herein, passive means any method that does not require the use of any electrically powered devices, such as pumps, compressors, and heaters. Also, as used herein, active methods rely on the use of electrically powered devices, such as pumps, compressors, and heaters. One example of a passive method of drying electronic devices is to place the wet device in a desiccant or a material (such as dry rice) that will absorb water by diffusion and absorption An example of an active method is part of a service offered by TekDry, LLC of Denver, Colo. The TekDry™ method employs an electrically powered system that includes a drying chamber into which a wet electronic device is placed. The chamber is coupled to an electrically powered vacuum pump that maintains the pressure inside the chamber at a partial vacuum when the pump is turned on. Also, the chamber is heated by an electrically powered heater that heats the drying chamber while the vacuum pressure is maintained. However, the TekDry™ system is expensive and is only available as a service offered at certain retail locations. The financial cost of the system may be many times greater than the replacement cost of a respective wet electronic device, making a consumer purchase of such active drying system impractical. Further, the size of the TekDry™ system is large and impractical to store, especially when the system will likely be used infrequently. Thus, such active systems are not cost effective or practical for consumer users to own, and may be impractical for those consumers who are geographically too far to avail themselves of the TekDry™ service at the limited number of available retail locations.

SUMMARY

A kit is described that can be used for passively drying an electronic device that has become wet. According to one embodiment, a kit for drying an electronic device includes a sealed, negative pressure, vacuum container having a chamber that has been depressurized to a partial vacuum, and a drying container operably couplable to the containerized vacuum. The drying container includes a desiccant chamber containing a desiccant and an electronic device-receiving main chamber in fluid communication with the desiccant chamber. The main chamber is sized for housing a personal electronic device, such as a cell phone. The drying container may include a port at which to fluidly couple to the vacuum container.

The kit may further include a chemical heater couplable to the drying container and configured to heat the main chamber to a temperature above 80 degrees Fahrenheit (e.g., between 80 and 130 degrees Fahrenheit), and the drying container may include a heater housing adjacent to the main chamber configured to house the chemical heater, and the heater housing is thermally coupled to the main chamber.

The drying container may have an open first end defining a slot in communication with the main chamber. The slot is configured to receive the electronic device therethrough, and to be sealed closed. The port of the drying container may include a breakable seal or a one-way valve configured to open when fluidly coupled to the vacuum container. The desiccant chamber may be disposed between the main chamber and the port. In embodiments, the kit may include a seal attached to the first end of the drying container, and the open first end of the drying container may be configured to be sealed closed. Also, the drying container may have indicia indicating a location for cutting the drying container, such as to access the interior of the container to remove the electronic device therefrom after the first end is sealed closed.

The desiccant chamber may be bounded by porous fenestrated walls configured to contain the desiccant therebetween. The desiccant may be configured to change color as it absorbs water. The desiccant chamber may be configured to permit visual observation of the desiccant from outside of the drying container.

In embodiments, the vacuum container includes a first port sealed with an openable or breakable seal, and the drying container includes a second port in fluid communication with both the main chamber and the desiccant chamber. The second port is configured to couple to the first port, and the seal is configured to be opened or broken in during fluidly coupling of the second port to the first port. For example, the second port may include an opening element configured to pierce the seal of the first port as the first port is coupled to the second port.

According to another aspect, a method of drying an electronic device is described that includes providing a kit for drying the electronic device. The kit includes a sealed vacuum container having a chamber that has been depressurized to a partial vacuum. The drying container includes a desiccant chamber and a main chamber in fluid communication with the desiccant chamber. The main chamber is configured for housing an electronic device. The method further includes placing the electronic device inside the main chamber, sealing the drying container with the electronic device inside the main chamber, and fluidly coupling the vacuum container to the drying container to place the main chamber, desiccant chamber, and the vacuum chamber in fluid communication with each other. The vacuum chamber may be stored with a vacuum pressure of 1 Torr to 20 Torr. In use, a personal electronic device is placed inside the main chamber of the drying container and the main chamber is sealed. Then, the first port and the second port are coupled together and the breakable seal of the vacuum container is broken, which causes the chamber of the vacuum container to come into fluid communication with both the main chamber and the desiccant chamber of the drying container. As a result of the fluid communication, the main chamber and the desiccant chamber are depressurized until an equilibrium is reached between the chamber of the vacuum container and the main chamber and desiccant chambers of the drying container, at which all will be at a partial vacuum.

The kit may also include a chemical heater coupled to the drying container and configured to heat the main chamber when the heater is chemically activated, and the method may further include activating the chemical heater to heat the main chamber of the drying container. The method may also include heating the main chamber to a temperature above 80 degrees Fahrenheit (e.g., between 80 and 130 degrees Fahrenheit). The method may include observing a color change of the desiccant over time as the desiccant absorbs water extracted from the electronic device.

According to another aspect of the invention, a kit is described for drying an electronic device that includes a pressurized container holding a certain quantity of compressed dry gas at a pressure above atmospheric pressure. The pressurized container has a sealed outlet port. The kit also includes a drying container operably coupled to the pressurized container. The drying container includes a desiccant chamber and a main chamber in fluid communication with the desiccant chamber. The main chamber is configured for housing an electronic device. The drying container also includes a sealed inlet port, and a valve train and eductor fluidly coupled to the container between the main chamber and the sealed inlet port. The valve train may include a first valve fluidly coupled between the main chamber and the eductor, and a second valve fluidly coupled between the eductor and the inlet port of the drying container. The inlet port is configured to fluidly couple to the outlet port of the pressurized container.

DETAILED DESCRIPTION OF THE PREFERRED EMBODIMENTS

Figure 1:
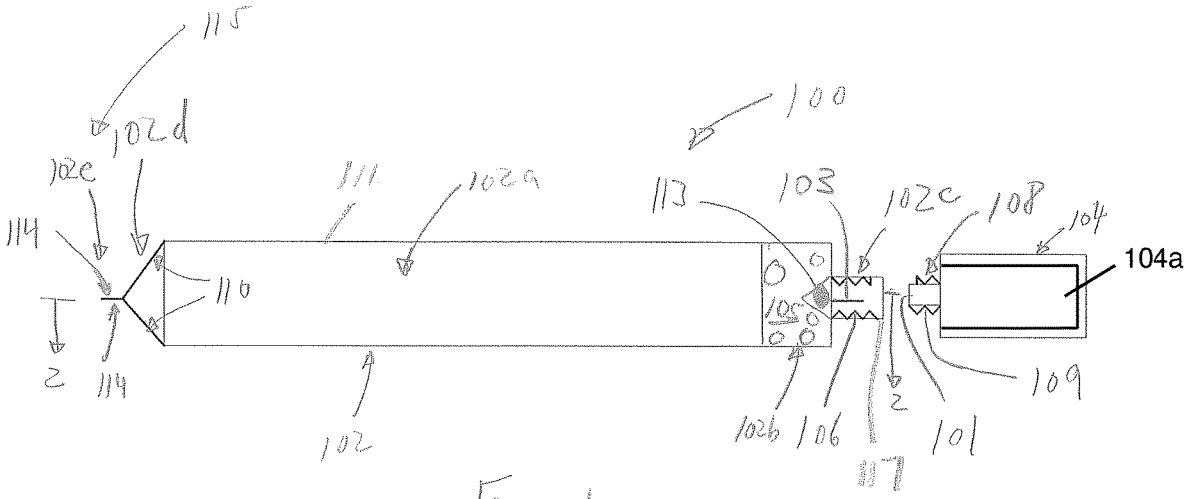
FIG. 1 is a view of a kit in accordance with an aspect of the disclosure.
Figure 2:
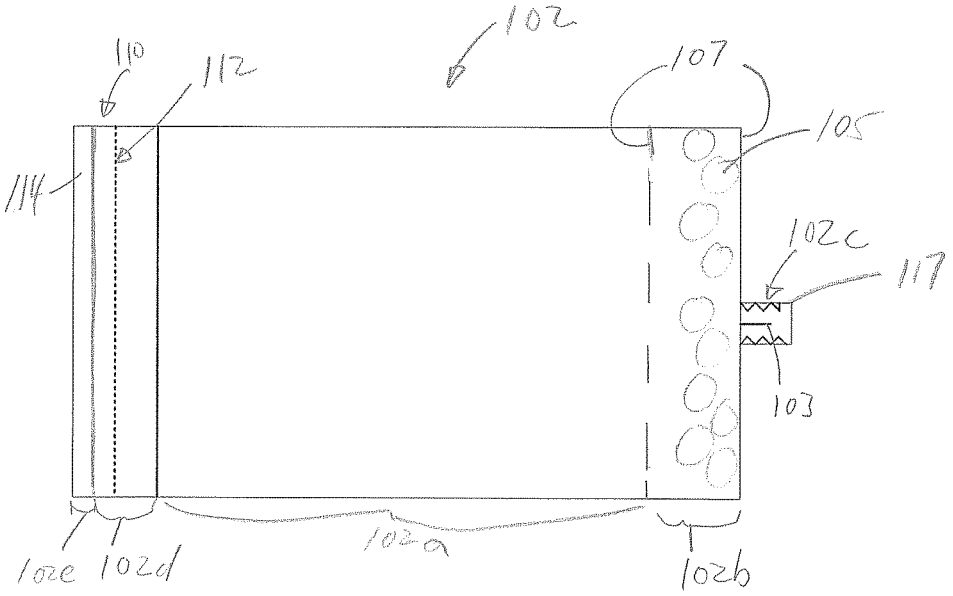
FIG. 2 is a view of a drying container of the kit of FIG. 1 viewed along line 2-2 in FIG. 1.

FIG. 1 shows an embodiment of a kit 100 in accordance with an aspect of the disclosure, further details of which are described below. The kit 100 includes a drying container 102 and a negative pressure storage container or a vacuum container 104. The drying container 102 is also shown in FIG. 2 along line 2-2 in FIG. 1.

The vacuum container 104 is a sealed container that has a vacuum chamber 104*a* that has been depressurized to hold a negative pressure (at a partial vacuum below atmospheric pressure). The vacuum pressure inside the vacuum container may be around 1 Torr to 20 Torr, for example. The vacuum container 104 is configured to be fluidly coupled to the drying container 102 via a connection between a port 108 of the vacuum container 104 and a port 102*c* of the drying container 102, further details of which are described herein below. The port 108 may be sealed by a breakable seal 101. Also, or alternatively, the port 108 may have a one-way valve (not shown) that is normally closed when the port 108 is disconnected from the port 102*c*, but may be opened by fluidly coupling the port 108 to the port 102*c* of the drying container 102, as described in greater detail hereinbelow.

The drying container 102 may be conceptualized as having a plurality of portions, including a main chamber 102*a*, a desiccant chamber 102*b*, a port 102*c*, a breakable portion 102*d*, and a closure portion 102*e*. The main chamber 102*a* is defined by a wall 111 that may be formed of stiff plastic, such as polycarbonate, to house an electronic device (e.g., a cellular telephone). In one embodiment, the wall 111 of the main chamber 102*a* is configured to withstand a vacuum of about 1 Torr to 20 Torr without causing the wall 111 to buckle or collapse. This is intended to prevent a situation where the electronic device may become fully encapsulated by collapsed wall 111 and sealed off from the desiccant chamber 102*b*, which will inhibit drying the electronic device. In one embodiment, the wall 111 has at least one portion that is clear to permit visual observation of the interior of the main chamber 102*a* from outside the drying container 102. The main chamber 102*a* has internal dimensions to accommodate the electronic device. For example, the internal dimensions may be about 8 inches long, 5 inches wide, and 0.75 inch high to accommodate a cell phone.

The desiccant chamber 102*b*, which contains desiccant 105, is adjacent to the main chamber 102*a*. The desiccant chamber 102*b* is in fluid communication with the main chamber 102*a* and the port 102*c*. The desiccant chamber 102*b* may have fenestrated porous barriers 107 (FIG. 2) on opposite sides of the chamber 102*b* to physically retain the desiccant 105 in the desiccant chamber 102*b*. The desiccant 105 is configured to absorb moisture, such as water in the electronic device that is placed in the main chamber 102*a*. As shown in FIG. 2, the desiccant 105 may be formed as beads, which may have a diameter of about 1 mm to 3 mm. Such beads 105 may be configured to change color as they absorb water. For example, the beads 105 may turn from blue to pink as more water is absorbed, and they may stop changing color when water is no longer being absorbed.

Examples of suitable desiccant includes silica gel beads. Preferably, the wall of the desiccant chamber 102*b* has a portion that is clear so that a user can visually observe the color change of the beads to determine the amount of water absorbed by the desiccant, which color change may indicate the progress of water removal from the electronic device.

The port 102*c* is coupled to the desiccant chamber 102*b* opposite the main chamber 102*a*, and extends to an end 117 of the drying container 102. The port 102*c* is configured to mechanically and fluidly couple with the port 108 of the vacuum container 104. As shown in the embodiment of FIG. 1, the port 102*c* has female threads 106, and the port 108 has male threads 109 that engage and mate with the female threads 106 of the port 102*c*. Of course, the male and female threads may be reversed so that the port 108 has female threads and the port 102*c* has male threads. The port 102*c* may include a pin 103 that is configured to puncture the breakable seal 101 of the port 108 as the threads 106 and 109 mate together. The port 102*c* may include a one-way valve 113 that is checked closed when the port 108 is decoupled from the vacuum container 104, but which will open when subject to a pressure differential across the valve 113. Alternatively, if the port 108 also includes a one-way valve in place of the breakable seal 101, the pin 103 may be configured to open the one-way valve of the port 108 as well as the one-way valve of the port 102*c* as the threads 106 and 109 mate together. It will be appreciated that at the point where the vacuum container 104 is unsealed, the fluid connection between ports 102*c* and 108 is sufficiently fluid tight so that a leak path is not created thereat.

The breakable portion 102*d* is on a side of the main chamber 102*a* opposite from the desiccant chamber 102*b*. The breakable portion 102*d* may include an annular portion of flexible material 110 that extends from the main chamber 102*a* to the closure portion 102*e*. The flexible material 110 is less rigid than the wall 111 of the main chamber 102*a*, but will bend when subject to a pressure range of 1 Torr to 20 Torr vacuum. In one embodiment, the material 110 of the breakable portion 102*d* is formed of an airtight, non-adhesive, leathery plastic material and may have a thickness of about 1 mm.

As shown in FIG. 2, the material 110 may display a score line 112 to guide a user to cut the material 110, such as with a scissors, to open the sealed container 102, such as to remove an electronic device after a drying operation is completed. In one embodiment, the line 112 shows the location of a cutting wire formed into the breakable portion 102*d* which can be pulled by a user to cut through the material 110 to open the container 102.

The closure portion 102*e* defines a slot 119 (FIG. 3) at an end 115 of the container 102 through which an electronic device 150 (FIG. 4) can be introduced into the main chamber 102*a*. The closure portion 102*e* is configured to seal the slot 119 closed. The closure portion 102*e* may include one or more sealing flaps or flanges 114 extending from the material 110 of the breakable portion 102*d*. The sealing flaps 114 can be brought together to form an airtight seal and close the end 115 of the container 102, as shown in FIG. 1.

The sealing flaps 114 may include a single-use closure means, such as an adhesive. For example, a pressure-sensitive adhesive tape may be attached to one sealing flap 114 while an opposed sealing flap 114 does not have such tape. The tape may include a layer of adhesive having one side of which directly attached to the corresponding flap 114 and having an opposite side directly attached to a releasable layer, which may be paper or plastic film, which can be peeled away to expose the unattached side of the adhesive layer. Thus, when used, a user can expose the adhesive layer of the tape on one flap 114 by peeling back the outer film layer and pressing the other flap 114 against the exposed adhesive to form an airtight seal between the two flaps 114.

Alternatively, the sealing flaps 114 may include a reclosable seal that can be unsealed and resealed at least once, which may eliminate the need for cutting the breakable portion 102*d* to open the drying container 102, as discussed above. For example, a resealable closure may use an interlocking seal, such as a ZipLoc™ seal used on ZipLoc™ storage bags.

The sealing flaps 114 are preferably less rigid than the material of the wall 111 of the main chamber 102*a* so that when subject to a pressure range of 1 Torr to 20 Torr vacuum the flaps will bend, but not break or collapse.

Figure 3:
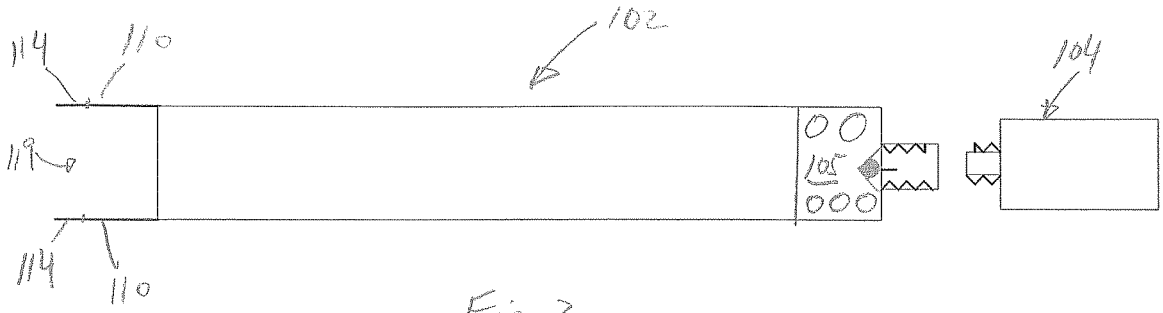
FIG. 3 shows the kit of FIG. 1 with the drying container in an open configuration.
Figure 4:
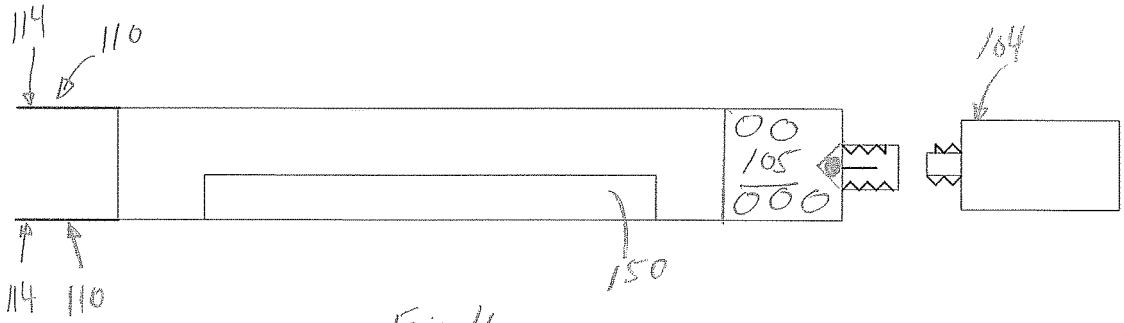
FIG. 4 shows the open drying container of FIG. 3 with an electronic device placed inside the open drying container.
Figure 5:
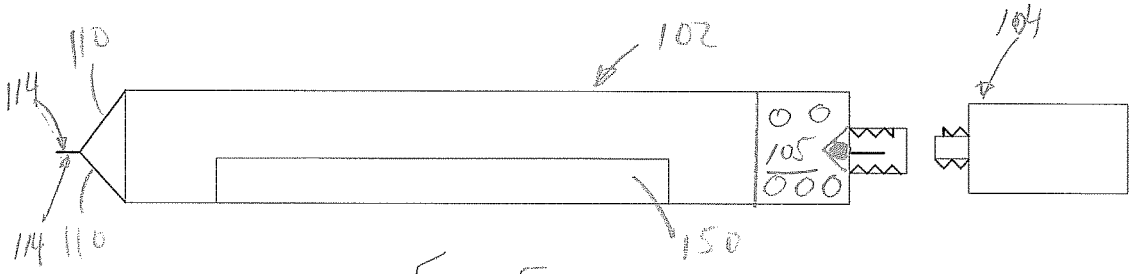
FIG. 5 shows the drying container of FIG. 4 in a closed configuration with the electronic device of FIG. 4 contained inside the closed drying container.
Figure 6:
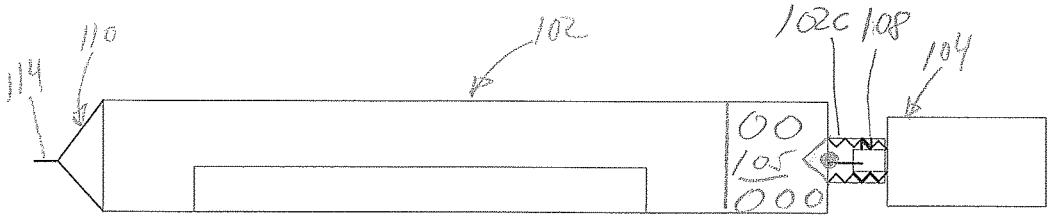
FIG. 6 shows the drying container and electronic device of FIG. 5 fluidly coupled to a storage container.

A workflow for using the kit 100 in a drying operation to dry an electronic device will now be described with reference to FIGS. 3 to 6. Initially, when a user receives the kit 100, the sealing flaps 114 will be unsealed. However, if the sealing flaps 114 are configured with a reclosable seal, the flaps 114 may be closed, so that initially, a user can unseal the flaps 114 to open the drying container 102. Thus, at the beginning of the workflow, the flaps 114 are unsealed and the drying container 102 is open, as shown in FIG. 3. Then, as shown in FIG. 4, an electronic device 150 is placed inside the main chamber 102*a* of the drying container 102. Then, as shown in FIG. 5, the flaps 114 are sealed together to enclose the electronic device 150 inside the drying container 102. With the electronic device 150 enclosed inside the drying container 102, the vacuum container 104 is fluidly coupled to the drying container 102 by threading the port 108 to port 102*c*, as shown in FIG. 6. Owing to the construction of the ports 102*c* and 108, as the ports are mechanically coupled, the container 104 will be unsealed and the interior of the drying container 102 will come into airtight fluid communication with the interior of the vacuum container 104. Due to the pressure differential between the drying container 102 and the vacuum container 104, the pressure in the drying container 102 will decrease until pressure equilibrium is reached with the vacuum container 104. Eventually, the pressure in the drying container 102 and the vacuum container 104 will equalize and the vacuum pressure in the container will facilitate water extraction from the electronic device 150.

As the drying operation progresses, water will be displaced from the electronic device 150, which can be absorbed by the desiccant 105, which can change color over time as water is absorbed. A user can view the color change of the desiccant 105 over time to gauge the rate of progress of water removal and whether the drying operation has ended. For example, a user can observe the color of the desiccant at periodic times and when the user notes that the color stops changing, the user can determine that water absorption has ended. The lack of further color change may indicate that the drying process is complete and that no further water needs to be removed from the electronic device. Sufficient desiccant 105 is provided to dry out the electronic device of water in a single use.

When the drying process is complete, a user can remove the electronic device 150 from the drying container 102, either by cutting the breakable portion 102*d* as discussed above, or by unsealing the flaps 114 if they are readily unsealable (i.e., if they are not adhesively sealed).

Figure 7:
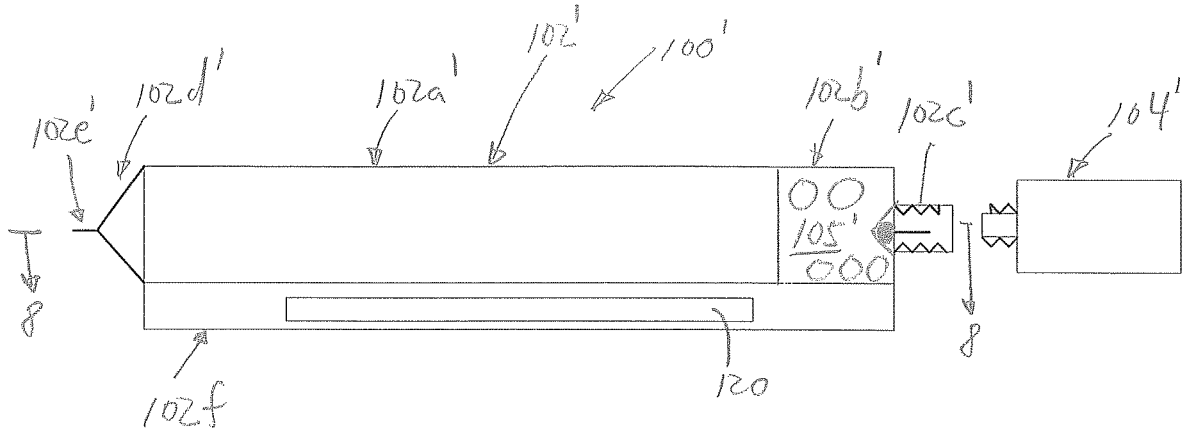
FIG. 7 is a view of another embodiment of a kit in accordance with the disclosure.
Figure 8:
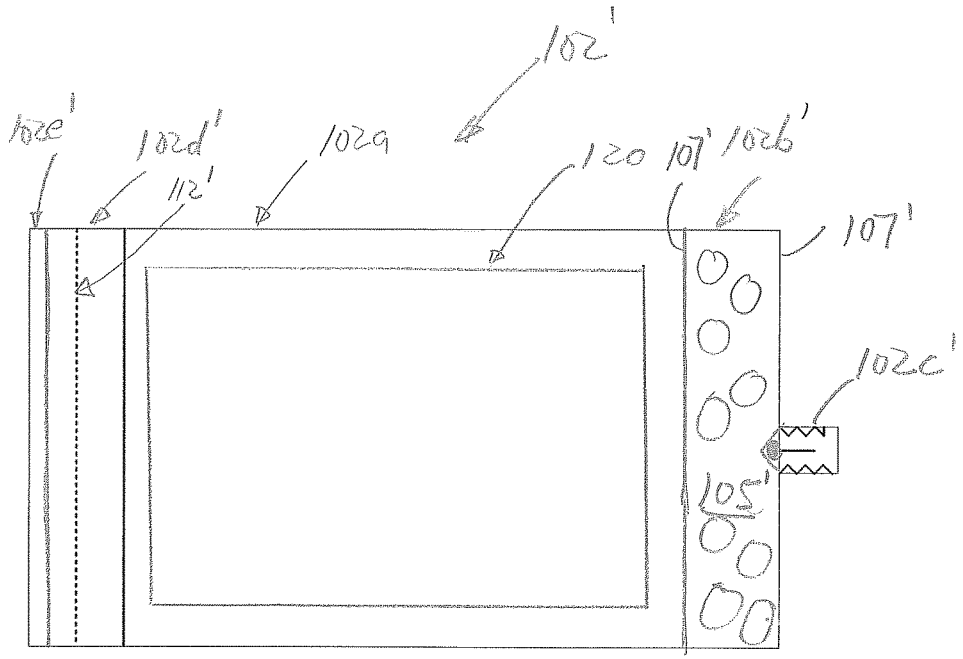
FIG. 8 is a view of a drying container of the kit of FIG. 7 viewed along line 8-8 in FIG. 7.

FIG. 7 shows another embodiment of a kit 100' that includes an alternate embodiment of a drying container 102'. In FIG. 7, elements of kit 100' corresponding to those of kit 100 are shown appended with a (′). Kit 100' includes a vacuum container 104', which is the same as vacuum container 104 as for kit 100, but includes a different drying container 102'. The drying container 102' differs only from the drying container 102 in that container 102' additionally includes a secondary chamber 102*f* directly below the main chamber 102*a*'. The secondary chamber 102*f* is suitably dimensioned and otherwise configured to receive a heater 120, such as a passive thermal heat pack. Preferably, the heater 120 is a chemical heat pack that may generate heat as a result of an exothermal chemical reaction between chemicals in the heat pack. Such chemical heat packs are well known, particularly in their use as hand and feet warmers. The heat from the heater 120 warms the interior of the main chamber 102*a*' to facilitate the water removal from an electronic device (e.g., device 150) placed in the main chamber 102'. The heater 120 is configured to raise the temperature of the main chamber 102*a*' to a temperature above 80 degrees Fahrenheit (e.g., between 80 and 130 degrees Fahrenheit).

Figure 9:
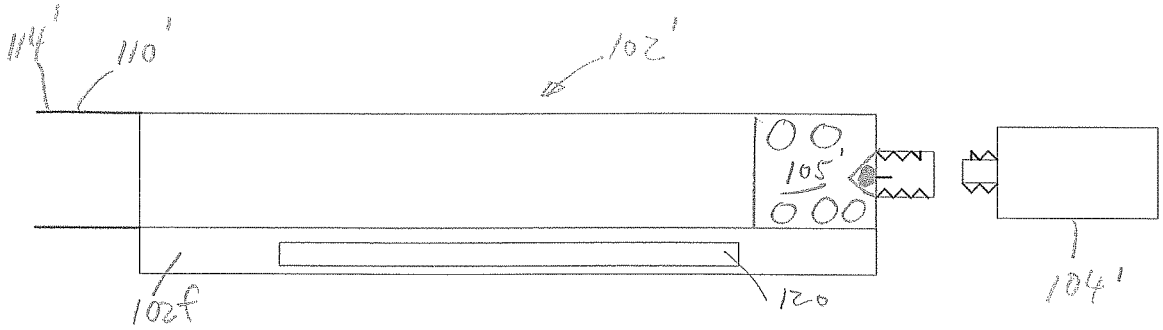
FIG. 9 shows the kit of FIG. 7 with the drying container in an open configuration.
Figure 10:
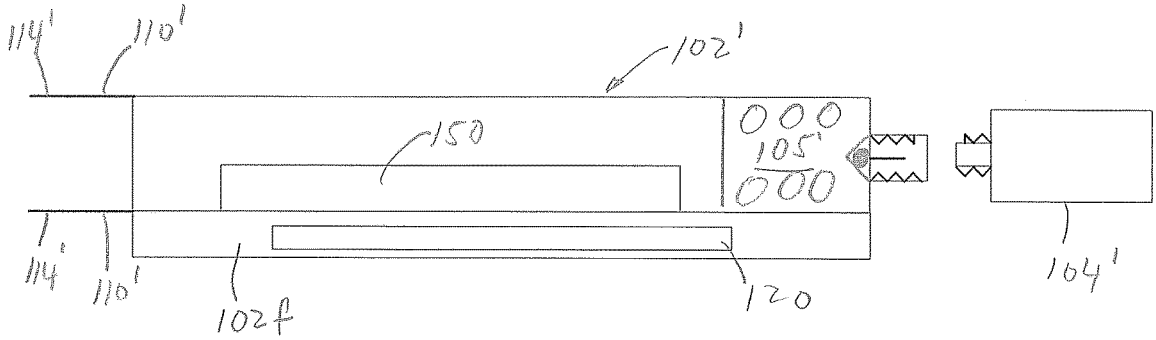
FIG. 10 shows the open drying container of FIG. 9 with an electronic device placed inside the open drying container.
Figure 11:
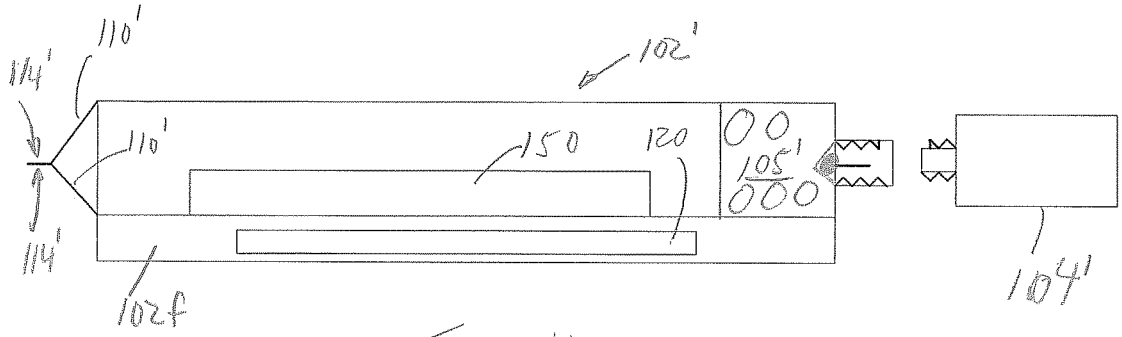
FIG. 11 shows the drying container of FIG. 10 in a closed configuration with the electronic device of FIG. 10 contained inside the closed drying container.
Figure 12:
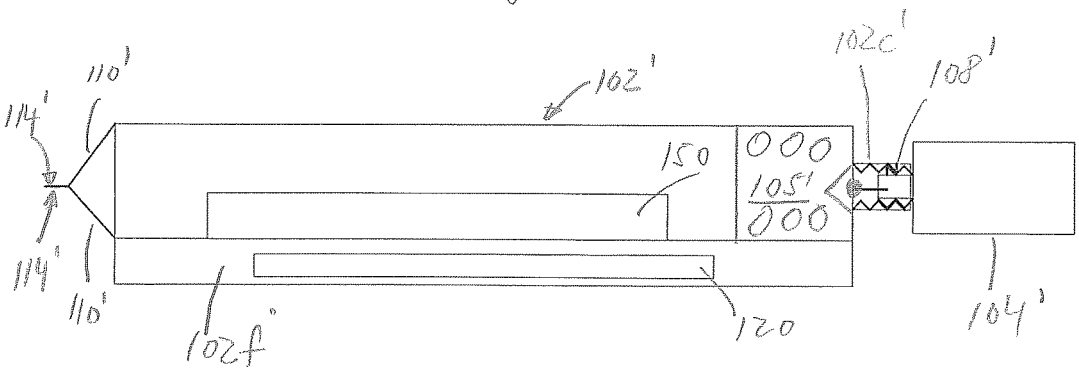
FIG. 12 shows the drying container and electronic device of FIG. 11 fluidly coupled to a storage container.

FIGS. 9 to 12 illustrate stages of a workflow for drying an electronic device 150 in the drying container 102'. Initially, at the beginning of the workflow, the flaps 114' are opened as shown in FIG. 9. The heat source 120' may be inserted into the secondary chamber 102*f* at any time and activated to produce heat, though it is shown in the secondary chamber 102*f* in FIG. 9. In FIG. 10, an electronic device 150 is placed inside the main chamber 102*a*' of the drying container 102'. Then, as shown in FIG. 11, the flaps 114' are sealed together to enclose the electronic device 150 inside the drying container 102'. With the electronic device 150 enclosed inside the drying container 102', the vacuum container 104' is fluidly coupled to the drying container 102' by threading the port 108 to port 102*c*'. Owing to the construction of the ports 102*c*' and 108, as the ports are mechanically coupled together in an airtight fashion, the interior of the drying container 102' will come into fluid communication with the interior of the vacuum container 104. Due to the pressure differential between the main chamber 102*a*' of the drying container 102' and the vacuum chamber of the vacuum container 104', the pressure in the drying container 102' will decrease until a pressure equilibrium is reached between the main chamber 102*a*' and the vacuum chamber. Eventually, the pressure in the drying container 102' and the vacuum container 104' will equalize and the vacuum pressure in the drying container 102' will facilitate moisture extraction from the electronic device 150 and absorption by the desiccant 105'.

As noted above, the heater 120 is configured to raise the temperature of the main chamber 102*a*' to a temperature above 80 degrees Fahrenheit. At room temperature, water will boil at a vacuum pressure of around 10 Torr. Thus, if the main chamber 102*a* experiences an elevated temperature above 80 degrees Fahrenheit and a vacuum pressure of between 1 Torr to 20 Torr, water in the electronic device 150 will evaporate quickly and speed up the water removal from the device, compared to the drying workflow of using the kit 100 without the heater 120.

Figure 13:
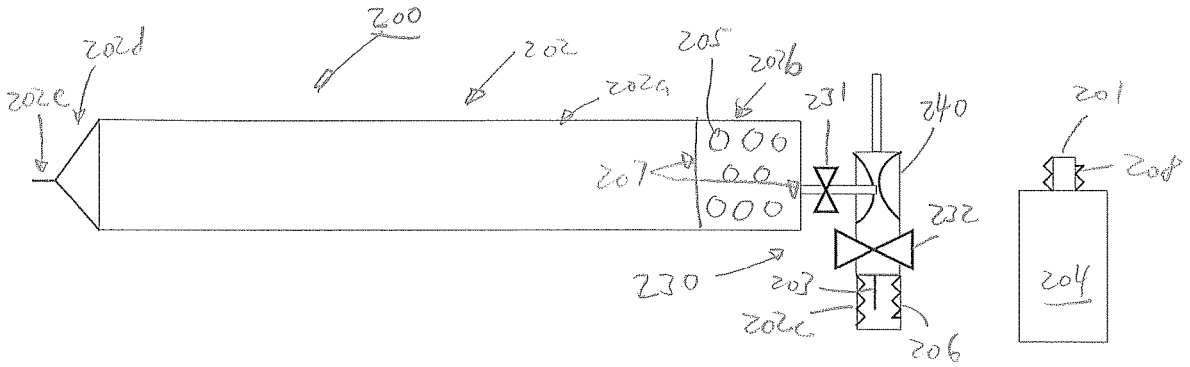
FIG. 13 is a view of another embodiment of a kit in accordance with the disclosure.

FIG. 13 shows another embodiment of a kit 200, where elements corresponding to elements of kit 100 are incremented by "100" in FIG. 13. The kit 200 includes a drying container 202 and a positive pressure storage container 204. The drying container 200 includes a main chamber 202*a*, a desiccant chamber 202*b*, breakable portion 202*d*, and a sealing portion 202*e*. The container 202 is coupled to a port 202*c* by a valve train 230 and an eductor 240. A first valve 231 is coupled between the desiccant chamber 202*b* and the eductor 240, while a second valve 232 is coupled between the eductor 240 and the port 202*c*. The port 202*c* is constructed in the same manner as port 102*c* and has female threads 206 and an opener 203 and one-way valve.

Unlike vacuum container 104, the positive pressure storage container 204 contains a compressed, dry gas (i.e. nitrogen or air) at a high pressure above atmospheric pressure. The pressurized storage container 204 has a port 208 constructed in the same manner as port 108 and may be sealed by a breakable seal 201 or may have a one-way valve. Such seal 201 or one-way valve may be punctured or opened by the opener 203 as the port 208 is coupled to the port 202*c*. Also, the port 208 has male threads 209.

Figure 14:
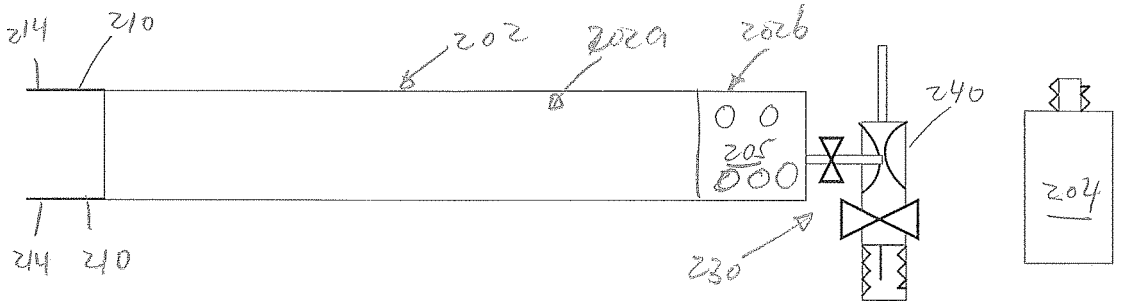
FIG. 14 shows the kit of FIG. 13 with the drying container in an open configuration.
Figure 15:
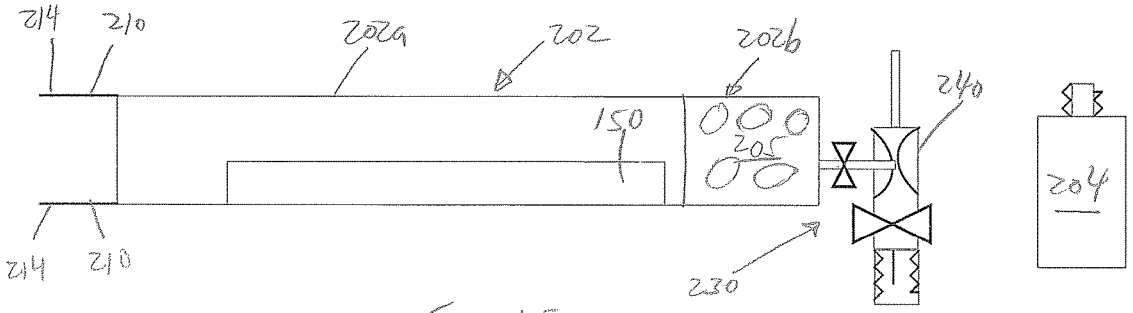
FIG. 15 shows the open drying container of FIG. 14 with an electronic device placed inside the open drying container.
Figure 16:
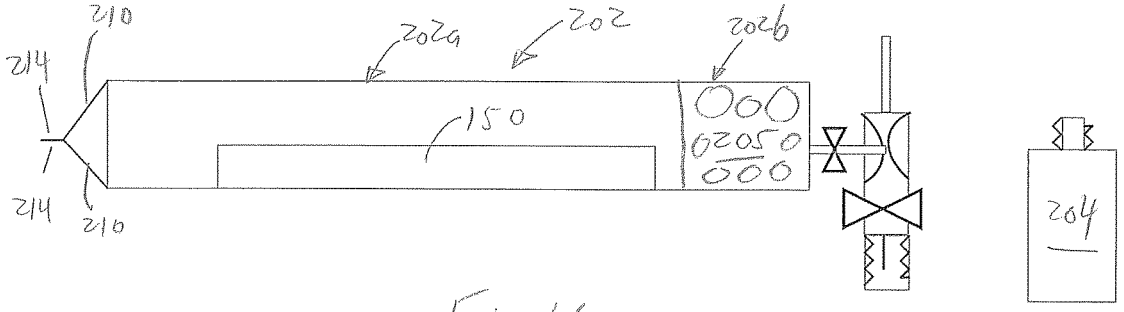
FIG. 16 shows the drying container of FIG. 15 in a closed configuration with the electronic device of FIG. 15 contained inside the closed drying container.
Figure 17:
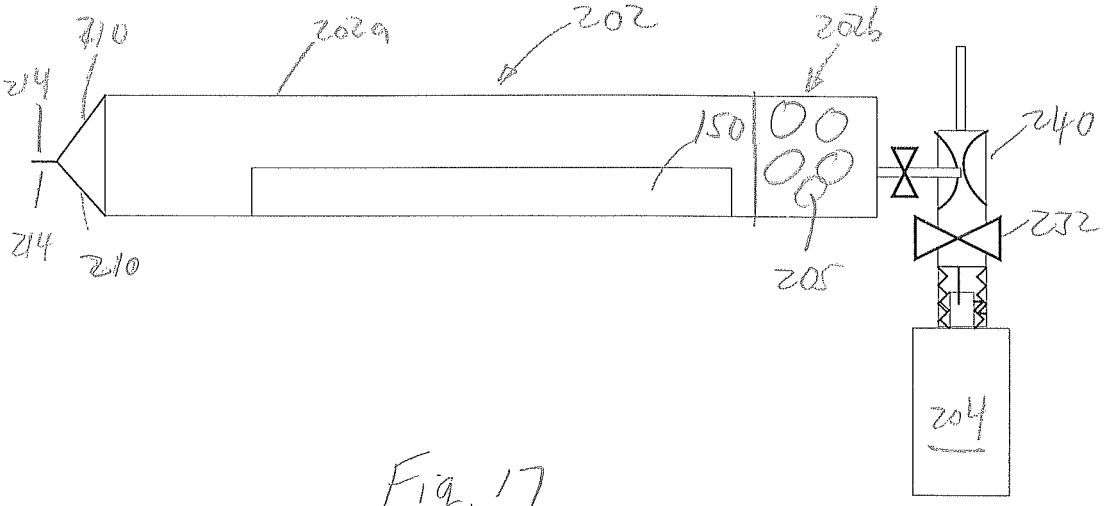
FIG. 17 shows the drying container and electronic device of FIG. 16 fluidly coupled to a pressurized storage container.
Figure 18:
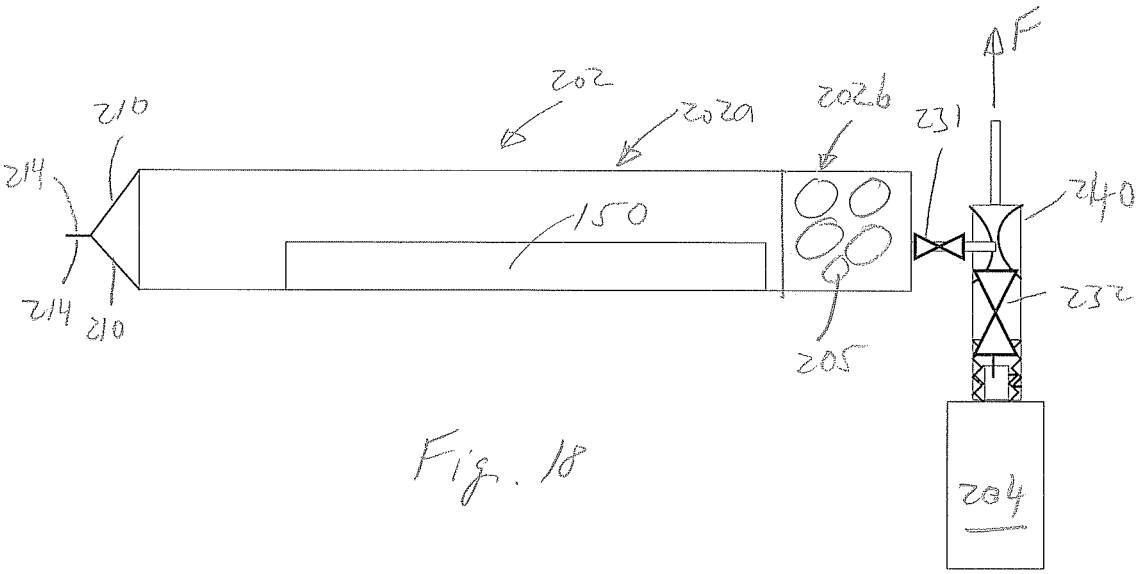
FIG. 18 shows valves configured to evacuate the drying container of FIG. 17.
Figure 19:
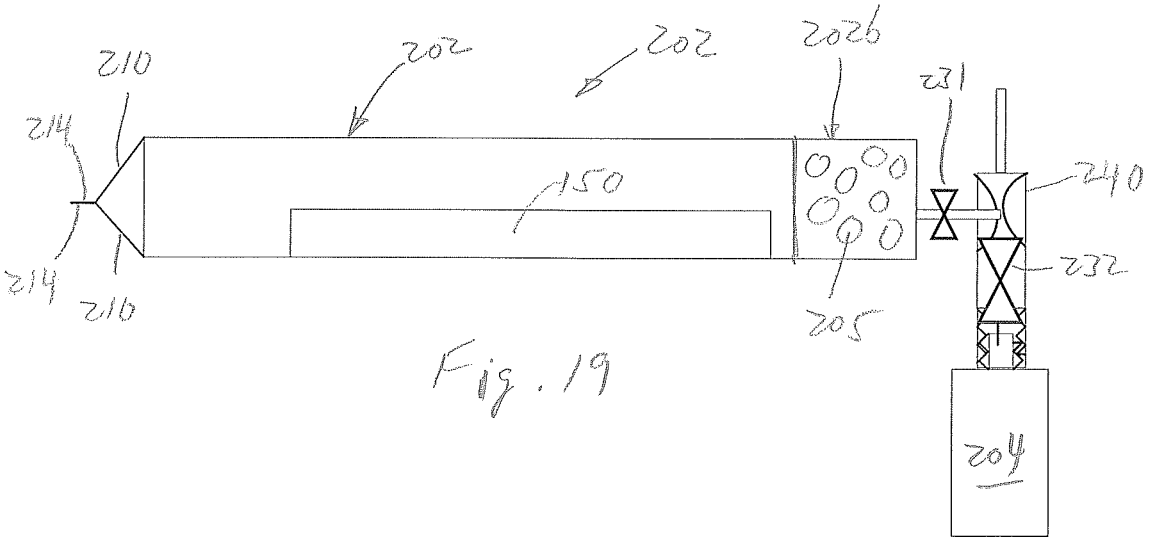
FIG. 19 shows the valves configured to stop the evacuation of the drying container and seal off the drying container.

The kit 200 may be used to dry an electronic device 150 in accordance with a workflow, described herein with reference to FIGS. 14 to 19. Initially, at the beginning of the workflow, the flaps 214 are opened as shown in FIG. 14. In FIG. 15, an electronic device 150 is placed inside the main chamber 202*a* of the container 202. Then, as shown in FIG. 16, the flaps 214 are sealed together to enclose the electronic device 150 inside the container 202. In FIG. 17, with the electronic device 150 enclosed inside the container 202, the pressurized storage container 204 is fluidly coupled to the container 202 by threading the port 208 to port 202*c*. Owing to the construction of the ports 202*c* and 208, as the ports are mechanically coupled together, the pressurized storage container 204 will be opened. However, as shown in FIG. 17, valve 232 is closed to prevent pressurized gas in storage container 204 from flowing into the eductor 240. In FIG. 18, the valves 231 and 232 are opened so that the pressurized fluid in the storage container 204 will flow through the eductor 240, which will cause air in the container 202 to be evacuated through the eductor 240 and mixed with the fluid from the storage container 204 and flow out of the eductor as shown by arrow "F". Once the pressure in the container 202 at a partial vacuum, the valve 231 can be closed, followed by valve 232, as shown in FIG. 19. The vacuum pressure in the container 202 will facilitate moisture extraction from the electronic device 150 and absorption by the desiccant 205.

It will be appreciated that the container 202 may be modified to include a secondary chamber and heat source, such as chamber 102*f* and heat source 120, directly below the main chamber 202*a*.

The kits and methods described herein provide various benefits over electronic device drying services like TekDry™. For example, the methods and kits described herein can be used rapidly, and without delay caused by a user having to locate and travel to a specific location offering a drying service, such as TekDry™. Such delay and transportation of the device can risk causing more damage to the device. Thus, rapid desiccation may save electronic devices that would otherwise be ruined by moisture in circuitry. The kits described herein may be purchased and stored in advance by a user for ready access and use when needed, so that an electronic device may be dried out quickly and passively after being wet. Furthermore, the kits and methods described herein may be useful in situations, such as camping, where electricity is not readily available.

There have been described and illustrated herein several embodiments of a kit and a method of using the kits for drying an electronic device. While particular embodiments of the invention have been described, it is not intended that the invention be limited thereto, as it is intended that the invention be as broad in scope as the art will allow and that the specification be read likewise. Thus, while particular seal and connection arrangements have been disclosed, it will be appreciated that other seals and connection arrangements may be used as well. Also, while vacuum storage containers and positive pressure containers have been disclosed, each can be generally referred to as a storage container having a chamber retained at a non-ambient pressure. It will therefore be appreciated by those skilled in the art that yet other modifications could be made to the provided invention without deviating from its spirit and scope as claimed.

What is claimed is:

1. A kit for passively drying an electronic device, comprising:

a detached, sealed storage container having a pressure chamber passively retained at a non-ambient pressure that is a partial vacuum; and a drying container configured to be coupled to the storage container, the drying container including a desiccant chamber containing a desiccant and a main chamber in fluid communication with the desiccant chamber, the main chamber configured for housing an electronic device, wherein the desiccant chamber and the main chamber are configured to be depressurized in a configuration in which the drying container is coupled to the storage container.

2. The kit according to claim 1, wherein:

the drying container includes a one-way valve fluidly coupled to the desiccant chamber and the main chamber and configured to open when the storage container is fluidly coupled to the drying container.

3. The kit according to claim 1, further comprising:

a chemical heater coupled to the drying container and configured to heat the main chamber to a temperature above 80 degrees Fahrenheit.

4. The kit according to claim 3, wherein:

the drying container includes a housing adjacent to the main chamber configured to house the chemical heater, wherein the housing is thermally coupled to the main chamber.

5. The kit according to claim 1, wherein:

the drying container has an open first end configured to receive the electronic device, and to be sealed closed, and has a port configured to couple the drying container to the storage container, wherein the desiccant chamber is disposed between the main chamber and the port.

6. The kit according to claim 5, further comprising:

an adhesive tape attached to the open first end of the drying container, the open first end of the drying container configured to be sealed with the adhesive tape.

7. The kit according to claim 6, wherein the drying container has indicia indicating a location to cut the drying container for opening the drying container to remove the electronic device therefrom.

8. The kit according to claim 1, wherein the desiccant chamber is bounded by porous fenestrated walls configured to contain the desiccant therebetween.

9. The kit according to claim 1, wherein the desiccant is configured to change color as it absorbs water, and wherein the desiccant chamber is configured to permit visual observation of the desiccant from outside of the drying container.

10. The kit according to claim 1, wherein:

the storage container includes a first port sealed with a breakable seal, and the drying container including a second port in fluid communication with the desiccant chamber and the main chamber, the second port configured to couple in an airtight manner to the first port, wherein the seal is configured to be broken in response to connecting the second port to the first port, and wherein when the first and second ports are connected, the main chamber, the desiccant chamber, and the pressure chamber are in fluid communication with one another.

11. The kit according to claim 10, wherein:

the second port includes an opening element configured to break the seal of the first port as the first port is connected to the second port.

12. A method of passively drying an electronic device, comprising:

i) providing a drying kit comprising:

a detached, sealed storage container having a pressure chamber that is passively retained at non-ambient pressure that is a partial vacuum, and a drying container operably coupled to the storage container, the drying container including a desiccant chamber containing a desiccant and a main chamber at an ambient pressure and in fluid communication with the desiccant chamber, the main chamber configured for housing an electronic device;

ii) placing the electronic device inside the main chamber;

iii) sealing the drying container with the electronic device inside the main chamber; and iv) fluidly coupling the storage container to the drying container to place the main chamber, the desiccant chamber, and the pressure chamber in fluid communication with each other and to depressurize the main chamber.

13. The method according to claim 12, wherein the partial vacuum is 1 Torr to 20 Torr.

14. The method according to claim 12, wherein:

the kit further includes a chemical heater coupled to the drying container and configured to heat the main chamber when the heater is chemically activated, and the method further comprising:

v) activating the chemical heater to heat the main chamber of the drying container.

15. The method according to claim 14, further comprising:

vi) heating the main chamber to a temperature above 80 degrees Fahrenheit.

* * * * *